US012376691B2

(12) United States Patent
Hill

(10) Patent No.: US 12,376,691 B2
(45) Date of Patent: Aug. 5, 2025

(54) MOUNTING METHOD AND DEVICE

(71) Applicant: Jayson Hill, Castle Rock, CO (US)

(72) Inventor: Jayson Hill, Castle Rock, CO (US)

(73) Assignee: PUNCH COLLAGE, LLC, Castle Rock, CO (US)

( * ) Notice: Subject to any disclaimer, the term of this patent is extended or adjusted under 35 U.S.C. 154(b) by 141 days.

(21) Appl. No.: 17/984,953

(22) Filed: Nov. 10, 2022

(65) Prior Publication Data

US 2023/0146157 A1 May 11, 2023

Related U.S. Application Data

(60) Provisional application No. 63/277,985, filed on Nov. 10, 2021.

(51) Int. Cl.
*A47G 1/17* (2006.01)

(52) U.S. Cl.
CPC ..... *A47G 1/17* (2013.01)

(58) Field of Classification Search
CPC ..... A47G 1/17; A47G 1/0638; A47G 1/1613; A47G 1/1606
USPC ..... 248/544, 466, 467, 497
See application file for complete search history.

(56) References Cited

U.S. PATENT DOCUMENTS

| | | | | |
|---|---|---|---|---|
| D112,534 | S | 12/1938 | Olszewski et al. | |
| D181,474 | S | 11/1957 | Antonio | |
| 3,861,639 | A * | 1/1975 | Morrill | A47G 1/1606 248/489 |
| D243,510 | S | 3/1977 | Shirey et al. | |
| 4,228,982 | A | 10/1980 | Sellera | |
| 4,437,639 | A | 3/1984 | Stein | |
| D275,868 | S | 10/1984 | Ake | |
| D280,433 | S | 9/1985 | Lincir | |
| D361,260 | S | 8/1995 | Trentham | |
| 6,880,259 | B1 | 4/2005 | Schultz | |
| D506,919 | S | 7/2005 | Munson et al. | |
| 8,333,026 | B2 | 12/2012 | Southard | |
| 9,183,006 | B2 | 11/2015 | Turcotte et al. | |
| 9,215,941 | B1 | 12/2015 | Kressin | |
| 9,279,538 | B1 | 3/2016 | Wening | |
| 9,395,044 | B2 * | 7/2016 | Cheng | F16M 13/022 |
| D821,188 | S | 6/2018 | Smullen | |
| 10,307,001 | B1 | 6/2019 | Fitzpatrick | |

(Continued)

FOREIGN PATENT DOCUMENTS

| | | | |
|---|---|---|---|
| JP | 2004-305723 | A | 11/2004 |
| JP | 2018075354 | A | 5/2018 |

(Continued)

OTHER PUBLICATIONS

"Non-Final Office Action Received for U.S. Appl. No. 17/752,720, mailed on Sep. 16, 2024."

(Continued)

*Primary Examiner* — Muhammad Ijaz
(74) *Attorney, Agent, or Firm* — Kutak Rock LLP; Neil Arney; Brian L. Main

(57) ABSTRACT

The present invention relates to a method and device for mounting pictures, art, and other images on a wall or other mounting surface by creating a receptacle on the back of a foamcore image or an image printed or placed on other solid core medium wherein the receptacle fits onto a mounting plate that is attached to the mounting surface.

26 Claims, 15 Drawing Sheets

(56) References Cited

U.S. PATENT DOCUMENTS

| | | | | |
|---|---|---|---|---|
| 10,331,319 | B2 | 6/2019 | Travis et al. | |
| D950,656 | S | 5/2022 | Andersson | |
| 11,690,464 | B2 * | 7/2023 | Spiro | A47G 1/17 40/747 |
| D1,018,733 | S | 3/2024 | Cardona | |
| 2006/0186306 | A1 | 8/2006 | Castle | |
| 2011/0138666 | A1 * | 6/2011 | Borde | A47G 1/166 40/747 |
| 2015/0132528 | A1 * | 5/2015 | Pirayesh | B32B 3/08 347/110 |
| 2015/0208835 | A1 | 7/2015 | Floyd et al. | |
| 2015/0216331 | A1 * | 8/2015 | Sanchez | A47G 1/02 248/467 |
| 2017/0055732 | A1 * | 3/2017 | Krake | F16M 13/02 |
| 2017/0200286 | A1 | 7/2017 | Brahmanapalli et al. | |
| 2019/0024370 | A1 * | 1/2019 | Wiggins | G09F 7/18 |
| 2019/0045948 | A1 * | 2/2019 | Gale | A47G 1/1613 |
| 2022/0000287 | A1 * | 1/2022 | Levis | F16M 11/16 |
| 2023/0110622 | A1 * | 4/2023 | Hill | A47G 1/1606 248/467 |
| 2023/0145688 | A1 * | 5/2023 | Hill | A47G 1/1606 40/713 |
| 2023/0146157 | A1 * | 5/2023 | Hill | A47G 1/1606 248/544 |

FOREIGN PATENT DOCUMENTS

| | | | |
|---|---|---|---|
| KR | 10-2012-0000275 | A | 1/2012 |
| KR | 10-20140007220 | A | 1/2014 |
| WO | 2023034314 | A1 | 3/2023 |
| WO | 2023086128 | A1 | 5/2023 |

OTHER PUBLICATIONS

"Notice of Allowance Received for U.S. Appl. No. 17/899,306, Mailed on Sep. 11, 2024".

"Final Office Action received for U.S. Appl. No. 17/899,306, Mailed on May 17, 2024".

"Non-Final Office Action received for U.S. Appl. No. 17/899,306, Mailed on Jul. 6, 2023", 14 Pages.

"International Search Report and Written Opinion for International Application No. PCT/US2022/030776, Search completed on Sep. 16, 2022 Mailed on Sep. 16, 2022."

"International Search Report and Written Opinion for International Application No. PCT/US2022/042060, Search completed on Dec. 16, 2022, Mailed on Dec. 16, 2022."

* cited by examiner

MOUNTING METHOD AND DEVICE

CROSS-REFERENCE TO RELATED APPLICATIONS

This application claims priority pursuant to 35 U.S.C. 119(e) to U.S. Provisional Patent Application, Ser. No. 63/277,985, filed Nov. 10, 2021, the entire disclosures of which are incorporated herein by reference.

FIELD OF INVENTION

The present invention relates to a method and device for mounting pictures, art, and other images on a vertical surface.

BACKGROUND

Foamcore, form board, or paper-faced foam board (collectively "foamcore") is a popular medium used for printing photographs, artwork, or other images. The popularity of foamcore is based on its low cost, light weight, and the ability to print on its surface or apply or adhere photos, artwork or other images on its surface. Foamcore also is a medium commonly used for creating a series of photographs, artwork, or other printed images to be arranged as a collage on a wall or other vertical mounting surface.

There are various methods and devices on the market that can be used to mount images printed on foamcore, including methods using hooks, wires, pins, nails, or adhesives. The known methods, however, provide limited guidance in laying out a series of images, making the layout and mounting of multiple images difficult and time consuming. Thus, what is needed is a method and device for easily mounting foamcore or other dimensional images and laying out and mounting multiple images in the nature of a collage or a gallery wall.

SUMMARY OF INVENTION

The following summary is provided to facilitate an understanding of some of the innovative features unique to the present invention. The present invention is not intended to be limited by this summary.

The present invention relates to a method and device for mounting one or more photographic prints, artwork prints, or other images ("images") on a wall or other vertical mounting surface. In a preferred embodiment, the images are printed or displayed on foamcore, but other solid core, dimensional mediums may be used. Using foamcore as an example, on the back of the foamcore image, at or near the center of the image, a portion of the foamcore is removed to form a carve-out receptacle (the "carve-out receptacle") for receiving a mounting plate. In a preferred embodiment, the carve-out receptacle is made using Computer Numerical Control (CNC) technology. The carve-out receptacle is shaped to receive the mounting plate that is sized and shaped to fit into the carve-out receptacle. Alternatively, a cup or ring that is engineered to fit onto the mounting plate is fixedly adhered into the carve-out receptacle on the back of the foamcore to form an engineered receptacle ("engineered receptacle") for the mounting plate. The carve-out receptacle and the engineered receptacle are herein referred to as a "receptacle."

In a preferred embodiment, the mounting plate is made of plastic or other rigid material. The mounting plate is designed in shape, size, and thickness to fit removably into the receptacle and allow the image to be mounted flush to the wall or other mounting surface. The term "flush" as used herein means that the backside surfaces of the image are parallel to and touching or nearly touching the mounting surface.

In a preferred embodiment, there is a means for removably connecting the receptacle onto the mounting plate. In one embodiment, the receptacle is elongated to allow the receptacle to fit onto the mounting plate, slide down and then removably lock onto the mounting plate. Such an embodiment creates a stable, lasting connection between the mounting plate and receptacle and reduces the likelihood that the receptacle will slip off the mounting plate. In other embodiments, there is a means for providing friction between the inner surface of the receptacle and the outer edges of the mounting plate to form a more stable connection between the mounting plate and receptacle. The frictional means may be mechanical or a material, such as a rubber, plastic, or cloth gasket, that provides friction between the inner surface of the receptacle and the outer edges of the mounting plate. In an embodiment, the frictional means includes engineered tolerances between the inner surface of the receptacle and the outer edges of the mounting plate to create friction when punched or pushed together. In another embodiment, the frictional means includes the use of magnets on the mounting plate and within the receptacle.

In a preferred embodiment, the receptacle and mounting plate are hexagonal, but may take any other common shape, including pentagonal, octagonal, triangular, rectangular, square, star, any other polygonal shape, circular, oval, clover leaf, heart, etc.

In a preferred embodiment, the mounting plate has a bulls-eye like opening at the center with targeting guides for ease in locating a predetermined mark on the mounting surface and placing the center of the mounting plate over that predetermined mark. An embodiment of the present invention also includes a bubble vial or other leveling means fixedly or removably attached to the mounting plate for leveling the mounting plate before removably affixing the mounting plate to the mounting surface. The shape, size, and orientation of the receptacle on the back of the image allows the image to be level when placed onto a level mounting plate. Once the mounting plate is leveled and removably affixed to the mounting surface, the receptacle at the back of the image is placed over and onto the mounting plate, creating a mounted, level image.

In an embodiment of the present invention, the mounting plate may be removably affixed to the wall or other surface by using known materials such as adhesive strips, adhesive tapes, adhesives, or using known mechanical fasteners, such as screws or nails. In an embodiment, the bulls-eye like opening at the center of the mounting plate is designed to receive a mechanical fastener for a more rigid and stable attachment of the mounting plate to the mounting surface. In an embodiment, the mounting plate includes one or more angled openings to allow nails or other fasteners to pass through the mounting plate and affix the mounting plate to a wall or other mounting surface. In such an embodiment, the combined use of an adhesive strip on the back of the mounting plate and angled fasteners allows large, heavy images to be mounted with minimal damage to the mounting surface. For larger, heavy images a plurality of receptacles may be carved out of the back of the image and a plurality of mounting plates used. Heavy images may include foamcore that is framed and/or covered with glass, or images that are on a heavier medium.

In an embodiment, the back side of the mounting plate includes one or more standoffs that are spring-loaded or that flex and break away, which allow the mounting plate to be leveled before pressing it against the mounting surface to engage an adhesive strip to removably affix the mounting plate to the mounting surface. After the mounting plate is placed over the predetermined mark on the mounting surface, leveled and removably affixed to the mounting surface, the receptacle at the back of the image is placed over and onto the mounting plate for a secure, level mounting of the image.

A preferred print medium for the disclosed methods and devices is foamcore, but other dimensional print mediums such as wood, plastic, and metal may be used. A benefit to the present invention is that it allows the image to be mounted flush to the wall or other mounting surface. It also provides an easy way to locate the center of an image at a predetermined location on the mounting surface and to level the mounted image by simply leveling the mounting plate as it is affixed to the wall.

The present invention also advantageously allows for mounting one or more images and laying out such images using templates that identify the center of each image where the receptacle is to be located and thus the center of the mounting plate. These predetermined locations for the mounting plates within a collage can be identified and placed onto the mounting surface using the template and without additional measurements. A preferred embodiment of the present method for use in mounting a collection of images includes a selection from predetermined templates for arranging the collection of images into various collages based on the number, size, and shape of the images. The templates, which may be temporarily placed or projected onto the mounting surface, identify the location of the receptacle on the back of each image of the collage and the center of each receptacle. That information facilitates the placement of predetermined marks on the mounting surface for the center of the mounting plate of each image within the collage. A mounting plate is then located over each predetermined mark on the mounting surface, leveled, and removably adhered to the surface of the wall. The receptacle on the back of each image will fit onto the mounting plate in the location established by the template, making a collage layout of properly located and level images. No additional measurements are required and no additional leveling of images is required.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DESCRIPTION OF DRAWINGS

The accompanying figures are incorporated herein and form a part of the specification for the present invention and further illustrate the present invention.

DETAILED DESCRIPTION OF INVENTION

Figure 1:
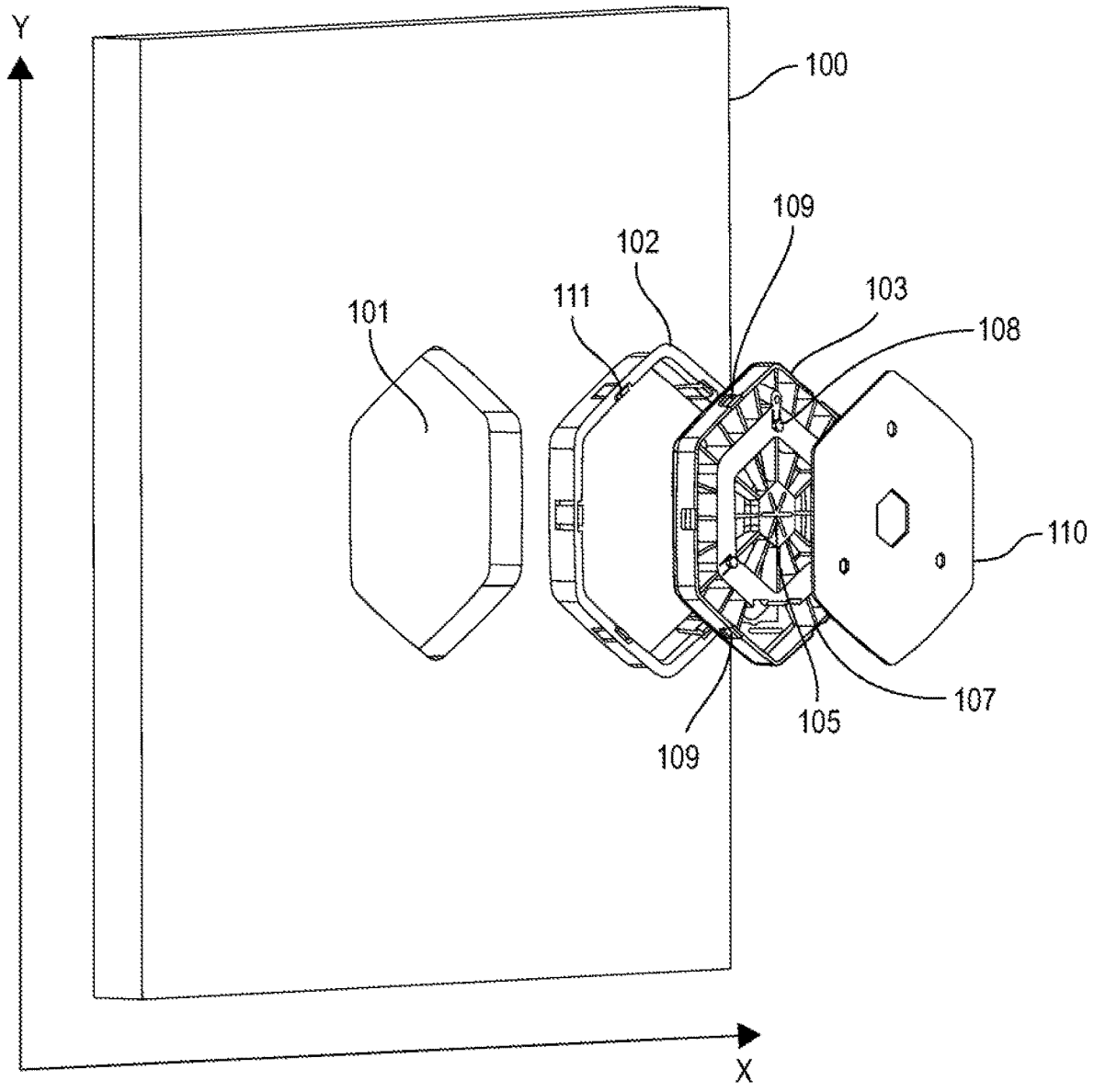
FIG. 1 is an exploded perspective view showing an image with a hexagonal carve-out on the back center of an image, a hexagonal receptacle cup to be fixedly adhered into the carve-out on the image, and a hexagonal mounting plate, according to an embodiment of the present invention.
Figure 2C:
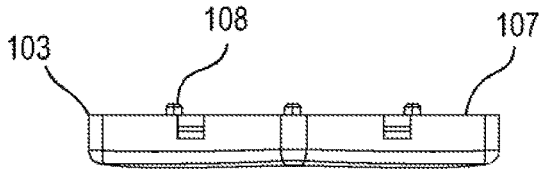
FIGS. 2*a* to 2*d* show a front view of the mounting plate with a hexagonal shape, a perspective front view of a mounting plate, a side view of the mounting plate, and a cross-sectional side view of the mounting plate, according to an embodiment of the present invention.
Figure 2B:
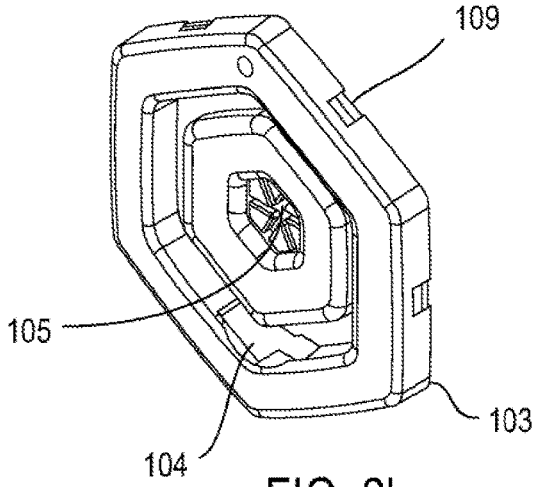
Figure 2A:
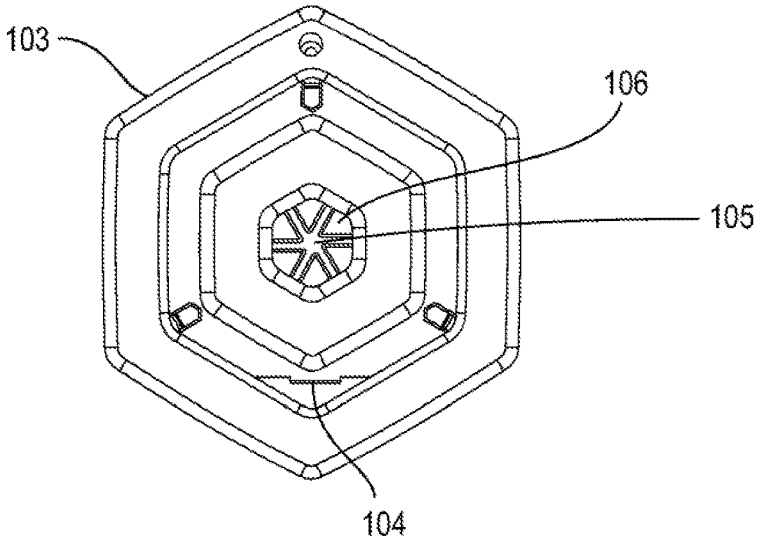
Figure 2D:
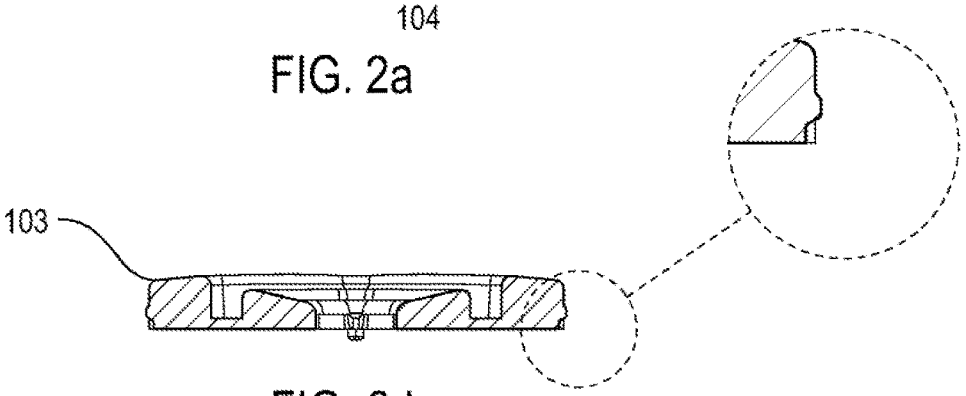

The present invention is best understood by reference to the detailed drawings and description set forth herein. Embodiments of the invention are discussed below with reference to the drawings. However, those skilled in the art will readily appreciate that the detailed description given herein with respect to the drawings is for explanatory purposes as the invention extends beyond the limited embodiments described. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number for a claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations. However, the use of such phrases should not be construed to imply a claim recitation by the indefinite articles "a" or "an" limits any particular claim containing such claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of claim recitations is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Throughout this disclosure, examples will be provided for using the methods and mounting devices disclosed. However, those skilled in the art will appreciate additional applications for the methods and mounting devices. Uses of the present invention may relate to, for example, mounting one or more prints, pictures, photographs, collages, wall art, artwork, or other images on a wall or other mounting surface.

The invention provides a method and device for mounting a single image or a plurality of images on a wall or other mounting surface. In a preferred embodiment of this invention, the image is printed on foamcore or other rigid dimensional medium such as wood, plastic, or metal. An area on the back of the foamcore or other medium is carved out to form the carve-out receptacle. In a preferred embodiment, the carve-out is created using CNC technology. The carve-out receptacle is located at or near the center of the image on the x-axis and at or above the center on the y-axis. Benefits of carving a receptable into the back of the image is that it provides a sturdy, stable mounting of the image and allows the image to be mounted flush to the mounting surface.

The carve-out receptacle is shaped to receive a mounting plate that is designed to fit into the carve-out receptacle. In another embodiment, the carve-out receptacle is designed to receive a cup or ring that is fixedly adhered into the carve-out receptacle on the back of the image to form an engineered receptacle for receiving the mounting plate.

In a preferred embodiment, the mounting plate is made of plastic or other rigid material and is of a shape, size and thickness that supports the weight of the image. The mounting plate is designed in shape, size, and thickness to fit removably into the receptacle and allow the image to be mounted flush to the wall or other mounting surface. In one embodiment, the receptacle is elongated to allow the receptacle to fit onto the mounting plate, slide down and then removably lock onto the mounting plate. Such an embodiment creates a stable, lasting connection between the mounting plate and receptacle and reduces the likelihood that the receptacle will slip off the mounting plate. In another embodiment, there is a means for providing friction between the inner surface of the receptacle and the outer edges of the mounting plate to form a more stable and lasting connection between the mounting plate and receptacle. The frictional means may be mechanical or a material, such as a rubber, plastic, or cloth gasket, that provides friction between the inner surface of the receptacle and the outer edges of the mounting plate. The mechanical frictional means may include outer edge of the mounting plate clipping into the inner edge of receptacle. In another embodiment, the frictional means includes engineered tolerances between the inner surface of the receptacle and the outer edges of the mounting plate to create friction when punched or pushed together. In another embodiment, the frictional means includes the use of magnets on the mounting plate and within the receptacle.

In a preferred embodiment, the mounting plate has a bulls-eye-like opening at the center with targeting guides for ease of locating a predetermined mark on a wall and placing the center of the mounting plate over that predetermined mark. An embodiment of the present invention also includes a vial level or other leveling means fixedly or removably attached to the mounting plate for leveling the mounting plate before removably attaching the mounting plate to a wall or other surface. The receptacle oriented on the back of the image and engineered in size and shape so that the image will be level when placed onto a level mounting plate.

In an embodiment of the present invention the mounting plate may be removably affixed to a wall or other surface by using known materials such as adhesive strips, adhesive tapes, adhesives, or by using mechanical fasteners, such as screws or nails. The size and shape of the receptacle and corresponding mounting plate are determined based on the size and weight of the image. An image that is larger and heavier may require a larger receptacle and corresponding mounting plate.

In an embodiment, the bulls-eye like opening at the center of the mounting plate is designed for use with a mechanical fastener for a more rigid, weight-bearing attachment of the mounting plate to the mounting surface. An embodiment of the mounting plate for the present invention also may have one or more downward-angled openings, allowing a fastener to pass through the opening for affixing the mounting plate to the mounting surface. The use of mechanical fasteners through the bulls-eye like opening or through the angled openings may be used to support large, heavy images. For example, the use of fasteners through angled openings in the mounting plate alone or in combination with adhesives placed between the mounting plate and the mounting surface, allows for large and heavy images to be mounted using the mounting method and device of the present invention. A three-inch mounting plate affixed to a wall with adhesive tape and with nails through the downward-angled openings can support an image weighing up to 150 pounds. For larger, heavy images a plurality of receptacles may be carved out of the back of the image and a plurality of mounting plates used to mount the image onto the mounting surface.

In an embodiment, the back side of the mounting plate includes one or more spring-loaded standoffs that allow the device to be leveled before pressing it against the wall to engage an adhesive strip or tab to removably adhere the mounting plate to the wall. After the mounting plate is placed over the predetermined mark on a wall surface, leveled and removably affixed to the wall, the receptacle on the back of the image is placed over the mounting plate for a secure, level mounting of the image.

The present invention advantageously allows for mounting one or more images printed on foamcore or other medium and laying out such images using templates that identify the center of each image where the mounting plate is to be located. These predetermined locations for the mounting plates within a collage can be identified using such a template and without additional measurements. The present invention also allows the images to be mounted flush to the mounting surface and without any additional leveling of the image.

A preferred embodiment of the present invention for use in mounting a collection of images includes a selection of predetermined templates for arranging the collection of images into various collages based on the number, size, and shape of the images. The templates, which may be temporarily placed or projected onto the mounting surface, identify the location of the receptacle on the back of each image of the collage and the center of each receptacle. That information facilitates placement of marks on the wall representing the center of the mounting plate for each image within the collage. A mounting plate is then located over each predetermined mark on the wall, leveled, and removably adhered to the surface of the wall. The receptacle on the back of each image will fit onto the mounting plate in the location established by the template, making a collage layout. A template may be used for a single image or a plurality of images.

To illustrate embodiments of the present invention, reference is made to the drawings. FIG. 1 shows the back of a foamcore image 100 with a carve-out 101 for receiving a mounting plate. The carve-out 101 is located at or near the center of the image 100 on the x-axis and at or above the center of the image 100 on the y-axis. In the embodiment illustrated by FIG. 1, a receptacle cup 102 is placed inside the carve-out 101 of the image 100 for receiving the mounting plate 103. The receptacle cup 102 is engineered to fit inside the carve-out 101 and to be affixed in the carve-out 101 using known adhesive means. In an alternative embodiment, a ring is used instead of a cup to form the receptacle 102 inside the carve-out 101. In another embodiment, no cup or ring is used, and the carve-out 101 is sized and designed to receive the mounting plate 103 directly.

In the embodiment shown in FIG. 1, the shape of the carve-out 101, the receptacle cup 102, and mounting plate 103 is hexagonal, but could be any polygonal shape, or any other shape such as circular, oval, clover, etc. that provides sufficient support for mounting the image 100 to a wall or other surface. In an alternative embodiment, the carve-out 100 may be circular and engineered to receive a receptacle cup 102 that is polygonal shape or to directly receive a mounting plate 103 that is polygonal.

In a preferred embodiment, as shown in FIGS. 1 and 2, the mounting plate 103 includes a bulls-eye like opening 105 and targeting guides 106 that allow the mounting plate 103 to be centered over a predetermined mark on a mounting surface. The use of the targeting guides 106 within the bulls-eye like opening 105 allows for the opening to be larger for ease in locating the predetermined mark on the wall and to aide in placing the center of the mounting plate 103 over the predetermined mark. In a preferred embodiment, the targeting guides 106 are arrow shaped and pointing to the center of the mounting plate, but the targeting guides 106 may take other shapes that identify the center of the mounting plate 103.

Figure 4A:
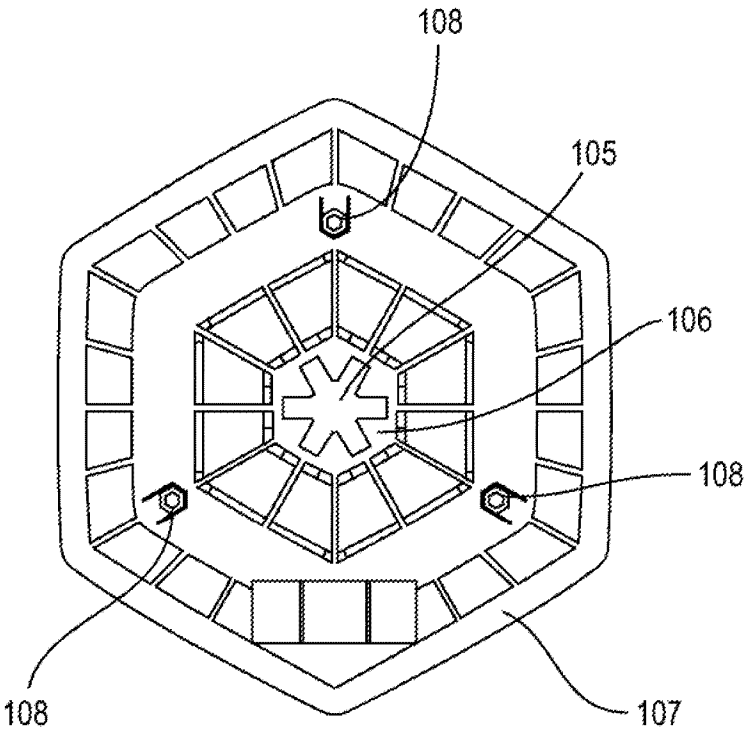
FIGS. 4*a* and 4*b* show a back view and a perspective back view of a mounting plate with a hexagonal shape, according to an embodiment of the present invention.
Figure 4B:
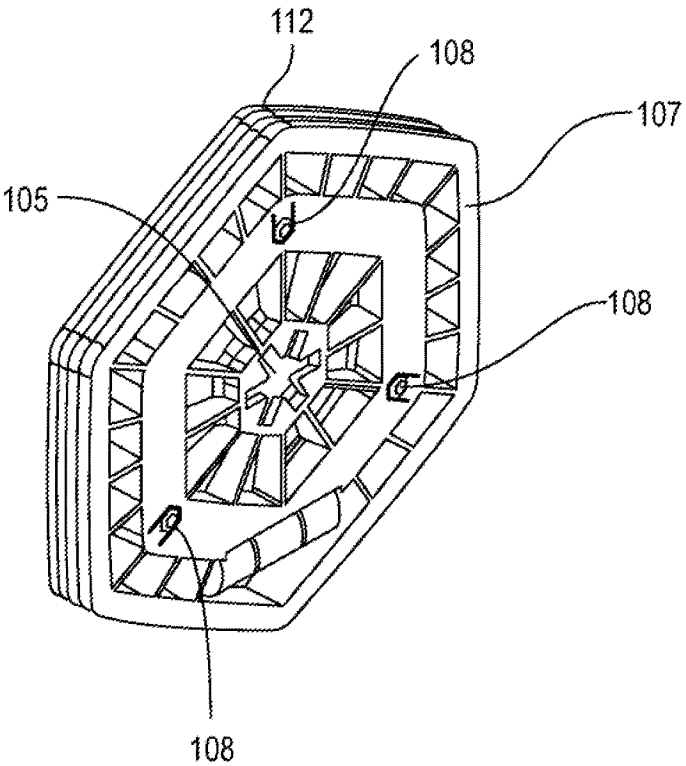

In a preferred embodiment of this invention, the mounting plate 103 is removably adhered to a wall or other mounting surface using an adhesive strip 110 that has a size and shape similar to the mounting plate 103. The adhesive strip 110 fixedly adheres to the back of mounting plate 103 and removably adheres to the mounting surface. In such embodiment, as shown in FIGS. 1, 2, and 4, the back surface 107 of the mounting plate 103 includes a plurality of flexible or breakable standoffs 108 that allow the mounting plate 103 to be centered over a predetermined mark on a mounting surface, held against the wall and leveled without engaging the adhesive strip 110 with the mounting surface. When the mounting plate 103 is centered over the predetermined mark on the mounting surface and is leveled, the mounting plate 103 can be pressed against the mounting surface causing the standoffs 108 to flex or break, engaging the adhesive strip 110 to removably adhere the mounting plate 103 to the mounting surface.

Figure 3B:
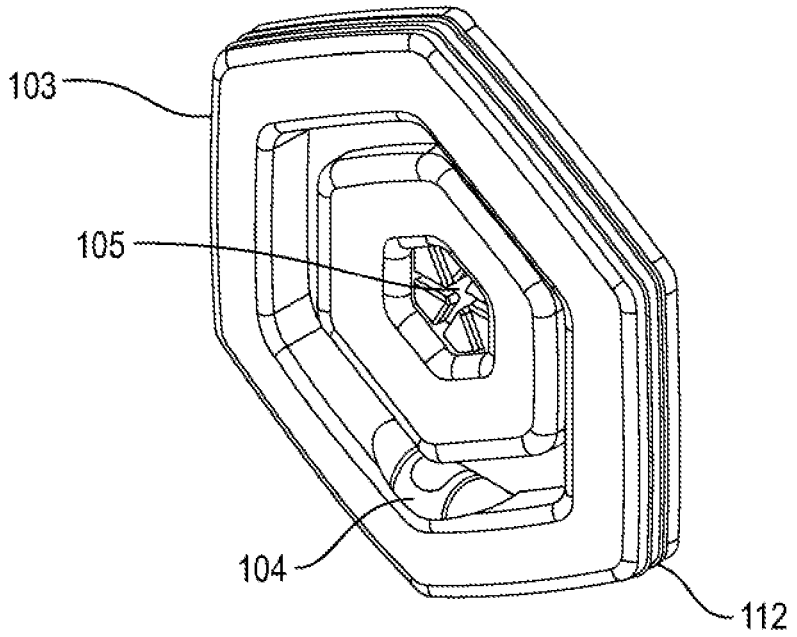
FIGS. 3*a* and 3*b* show an embodiment of the mounting plate of the present invention with an affixed bubble vial, including a front view and a perspective front view.
Figure 3A:
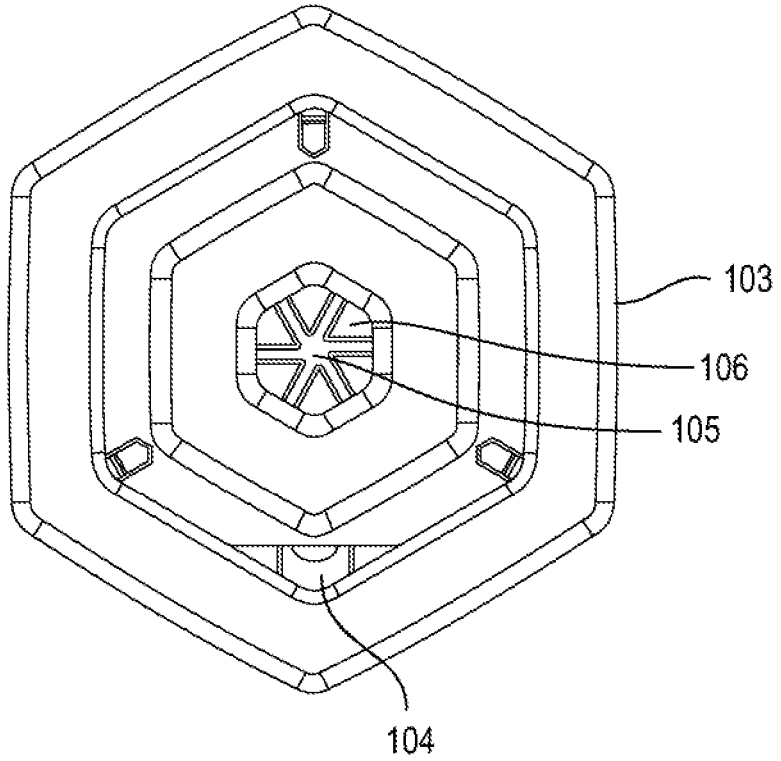

In a preferred embodiment of this invention as shown in FIGS. 2 and 3, the mounting plate 103 has a bubble vial level 104 fixedly or removably attached to the mounting plate 103 for use in leveling the mounting plate 103 before it is removably adhered or affixed to a wall or other mounting surface. The carve-out 101, the receptacle cup 102, and the mounting plate 103 are oriented and designed so that the image 100 will be level when placed onto a mounting plate 103 that is level on the mounting surface. Alternative leveling means may be used to level the mounting plate 103 before removably adhering or affixing the mounting plate 103 to a mounting surface.

In a preferred embodiment of the present invention, there is a means for creating friction between the mounting plate 103 and the carve-out 101 or between the mounting plate 103 and the receptacle 102, as the case may be. As an example, FIGS. 1, 2 and 7 show a mechanical means for removably connecting the mounting plate 103 to the receptacle 102, namely male clips 109 at the outer edge of the mounting plate 103 and female clips 111 at the inner edge of the receptable 102 that clip together to removably connect and lock the mounting plate 103 into the receptable 102 to prevent the mounted image 100 from slipping off the mounting plate 103.

Figure 8B:
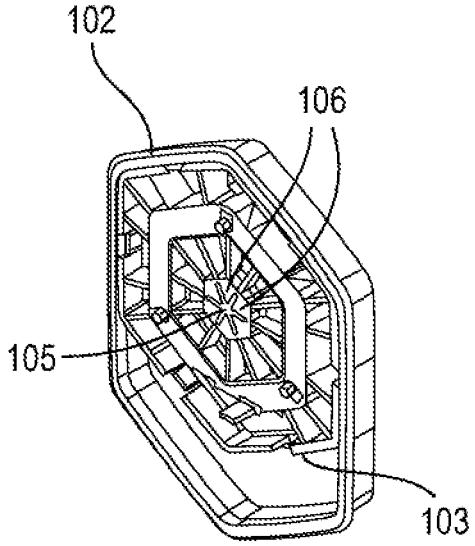
FIGS. 8*a* to 8*b* show an alternative embodiment of the present invention, namely a back view and back perspective view of an elongated receptacle placed over a hexagonal mounting plate, according to an embodiment of the present invention.
Figure 8A:
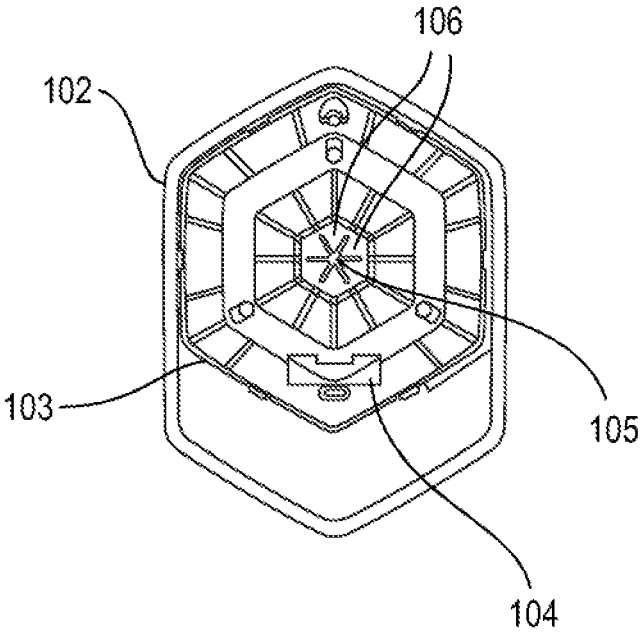

In another preferred embodiment, as shown in FIG. 8, the receptacle 102 is elongated along the y-axis allowing the receptacle 102 to fit onto the mounting plate 103, slide down onto the mounting plate 103 and removably lock onto the mounting plate 103. In this embodiment, the carve-out on the back of the image 100 is also elongated to receive the elongated receptacle 102. This embodiment may also include a means for locking the receptacle 102 onto a mounting plate 103, for example one or more protrusions at the top back edge of the receptacle 102 that slide over the mounting plate 103 to prevent the receptacle 102 and the image 100 from sliding off the mounting plate 103.

Figure 9:
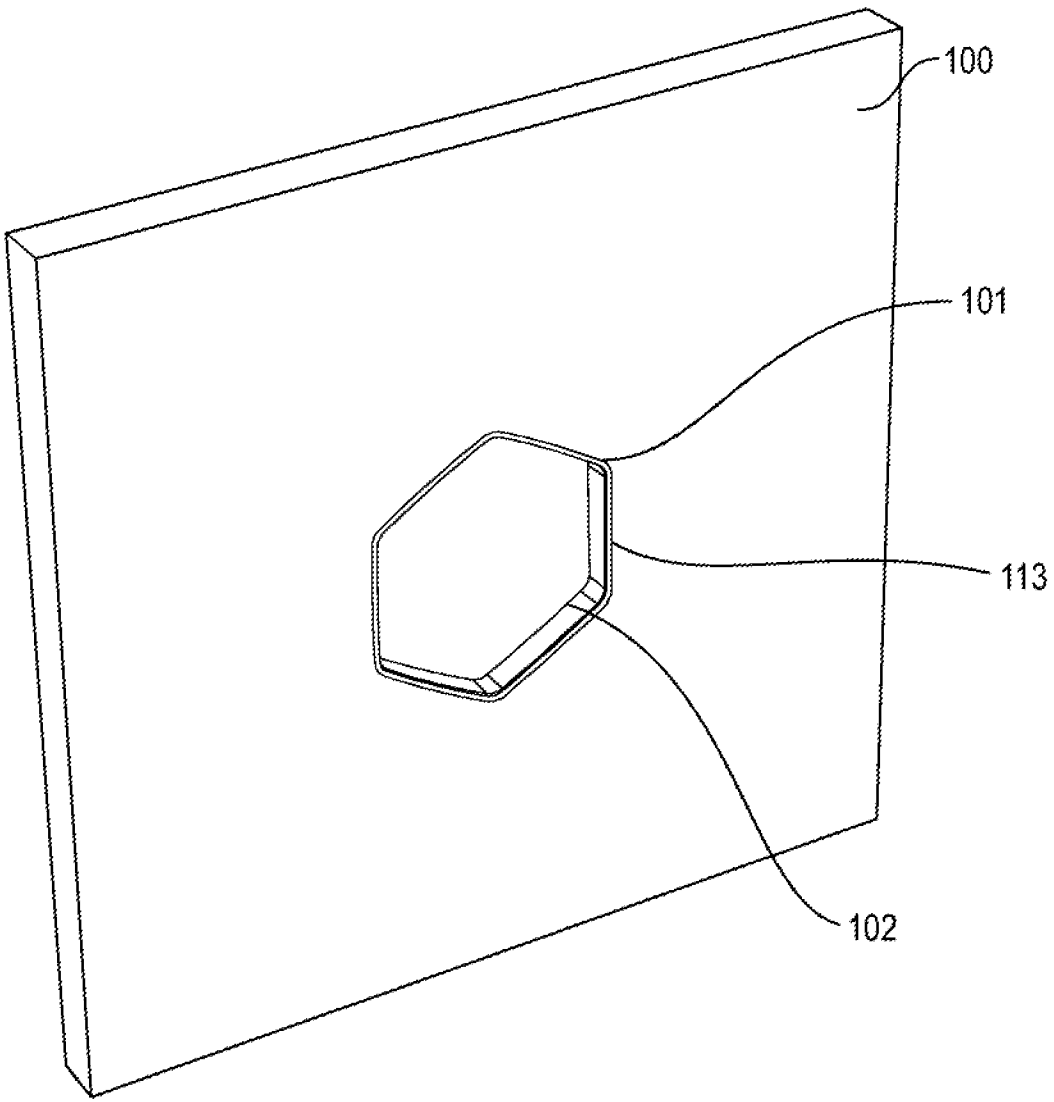
FIG. 9 is a perspective view of a hexagonal-shaped receptacle formed using a hexagonal-shaped receptacle cup placed into a hexagonal-shaped carve-out on the back of an image, according to an embodiment of the present invention.
Figure 10:
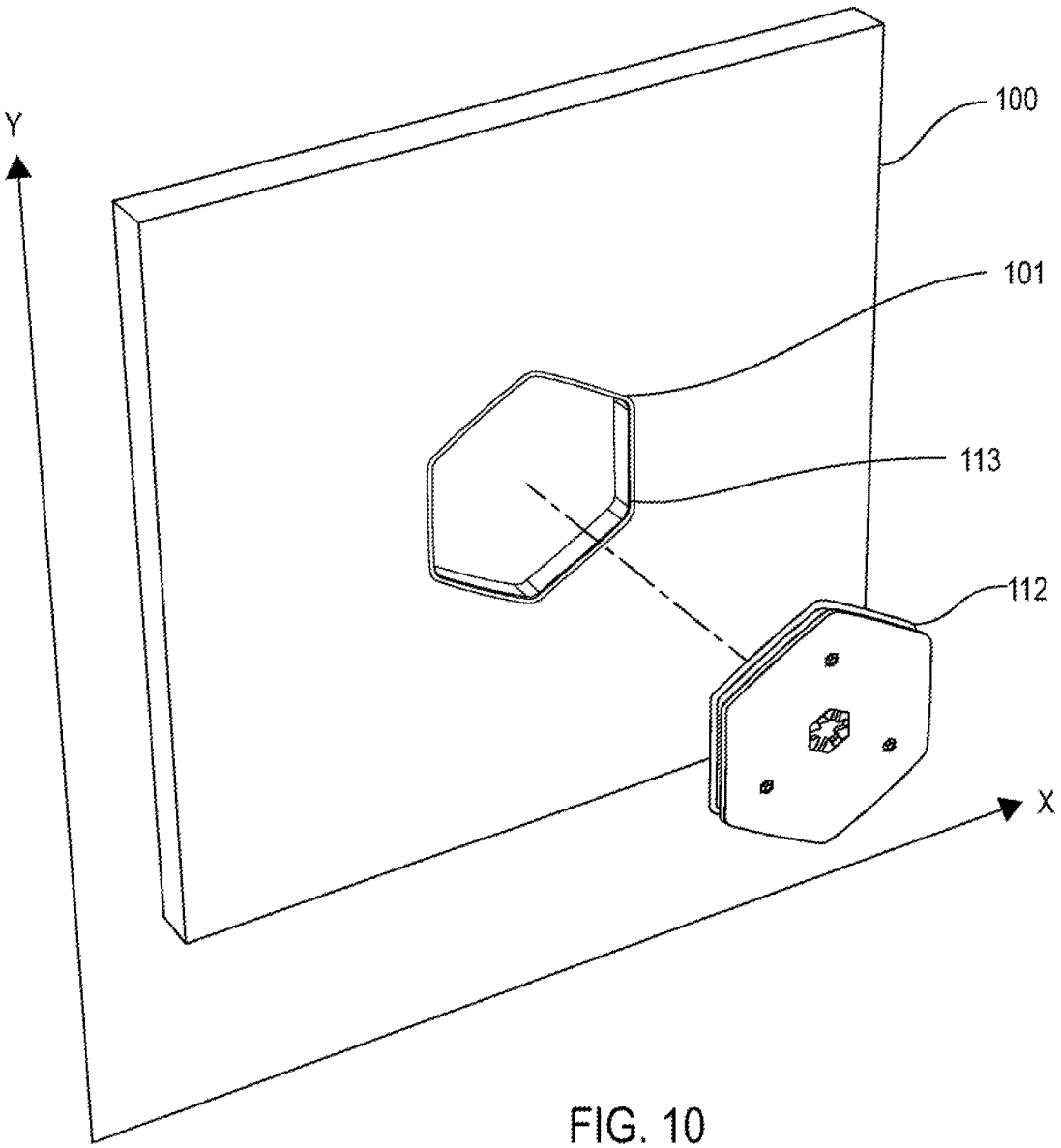
FIG. 10 is an exploded perspective view showing an image with a hexagonal carve-out on the back center of the image located at or near the center of the x-axis and at or above the center of the y-axis, a hexagonal receptacle cup adhered into the carve-out on the image, and a hexagonal mounting plate, according to an embodiment of the present invention.

In an alternative embodiment, the means for creating friction is a rubber gasket 112 on the outer edge of the mounting plate 103 as shown in FIGS. 3 and 4 and/or a rubber gasket 113 on the inner edge of the receptacle as shown in FIGS. 9 and 10. The frictional means provides a more stable mounting of the image 100 to prevent the image 100 from inadvertently sliding off the mounting plate 103. In other embodiments, the frictional means may include other known friction causing materials on the outer edges of the mounting plate 103 and/or on the inner surface of the receptacle 102. The frictional means may also include other known mechanical means for friction or by engineering and manufacturing the mounting plate 103 and the receptacle 102 so that there is friction between the outer edge of the mounting plate 103 and the inner surface of the receptacle 102 when the image 100 is mounted to prevent inadvertent slippage of the image 100 from the mounting plate 103. The frictional means may also include use of magnets to create a magnetic connection between the mounting plate 103 and the receptacle 102.

Figure 5A:
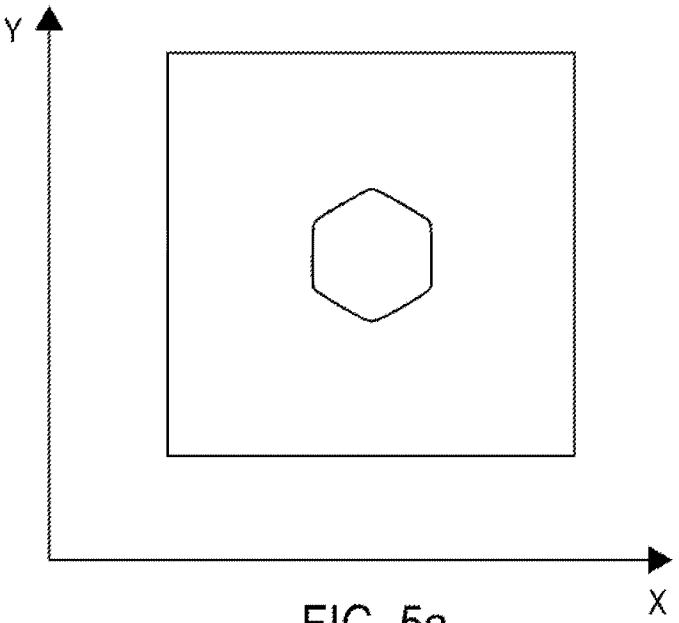
FIGS. 5*a* and 5*b* show a back view and a perspective back view of a hexagonal-shaped carve-out on the back of an image, according to an embodiment of the present invention.
Figure 5B:
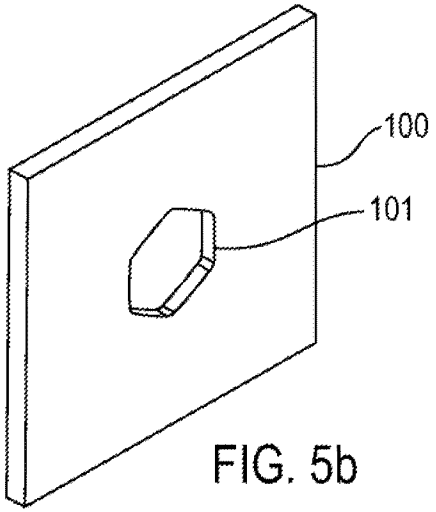
Figure 6A:
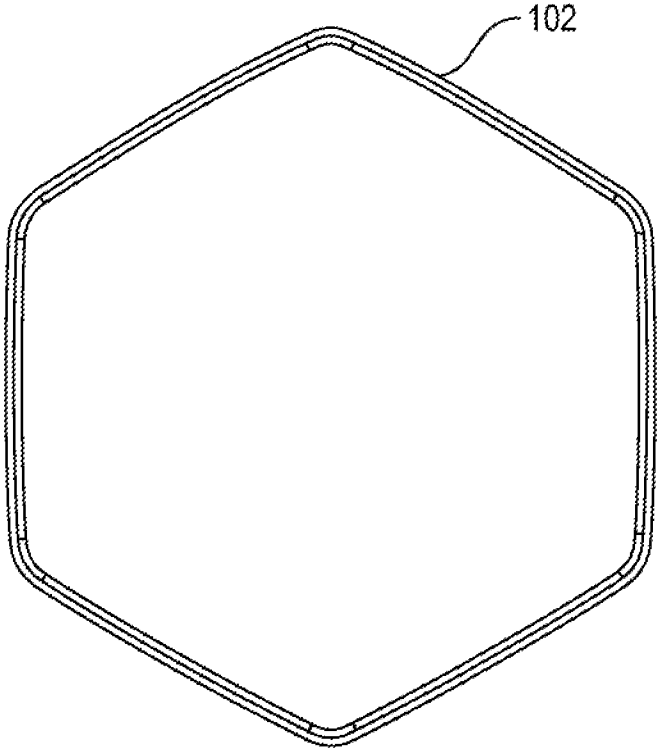
FIGS. 6*a* and 6*b* show a front view and a perspective front view of a hexagonal-shaped receptacle cup to be placed and adhered into the carve-out on the back of an image, according to an embodiment of the present invention.
Figure 6B:
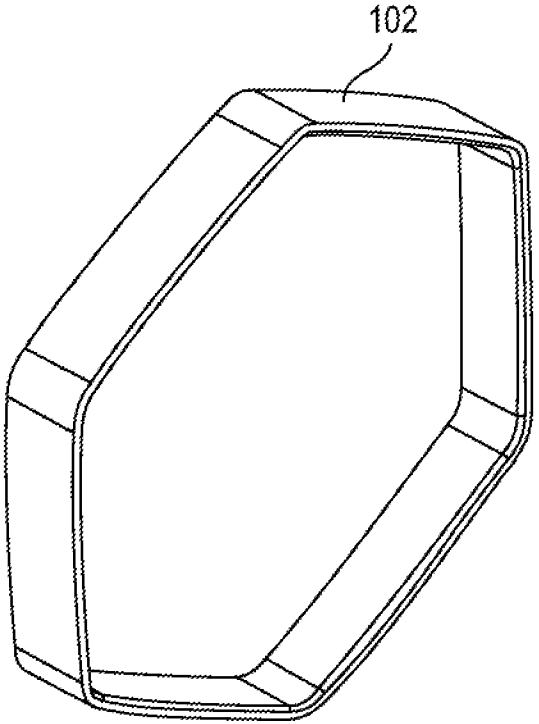
Figure 7C:
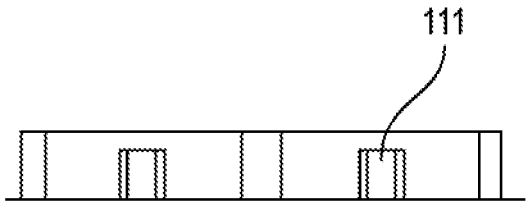
FIGS. 7*a* to 7*d* show an alternative embodiment of the receptacle cup of the present invention, namely a front view, a perspective front view, side view, and cross-sectional view of a hexagonal-shaped receptacle cup to be placed and adhered into the carve-out on the back of an image, according to an embodiment of the present invention.
Figure 7B:
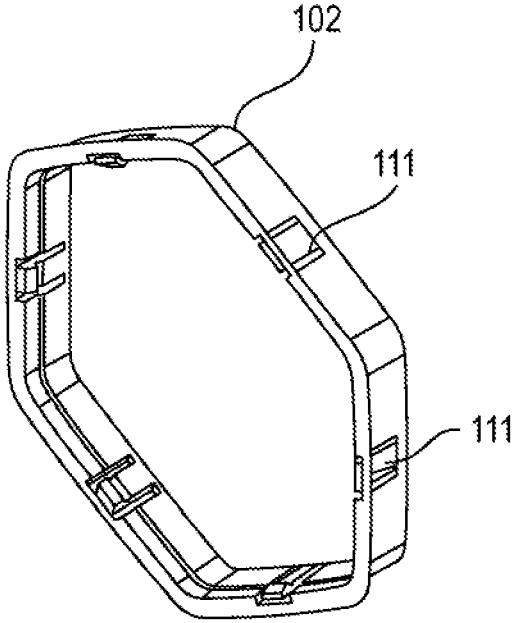
Figure 7A:
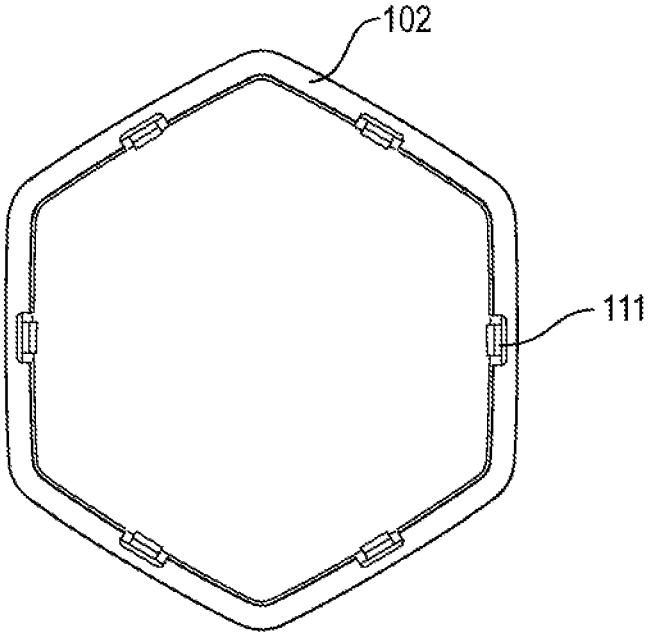
Figure 7D:
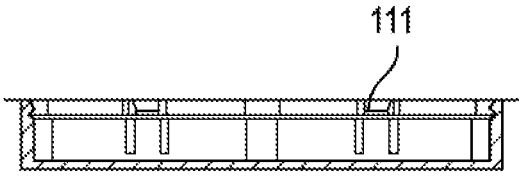
Figure 13:
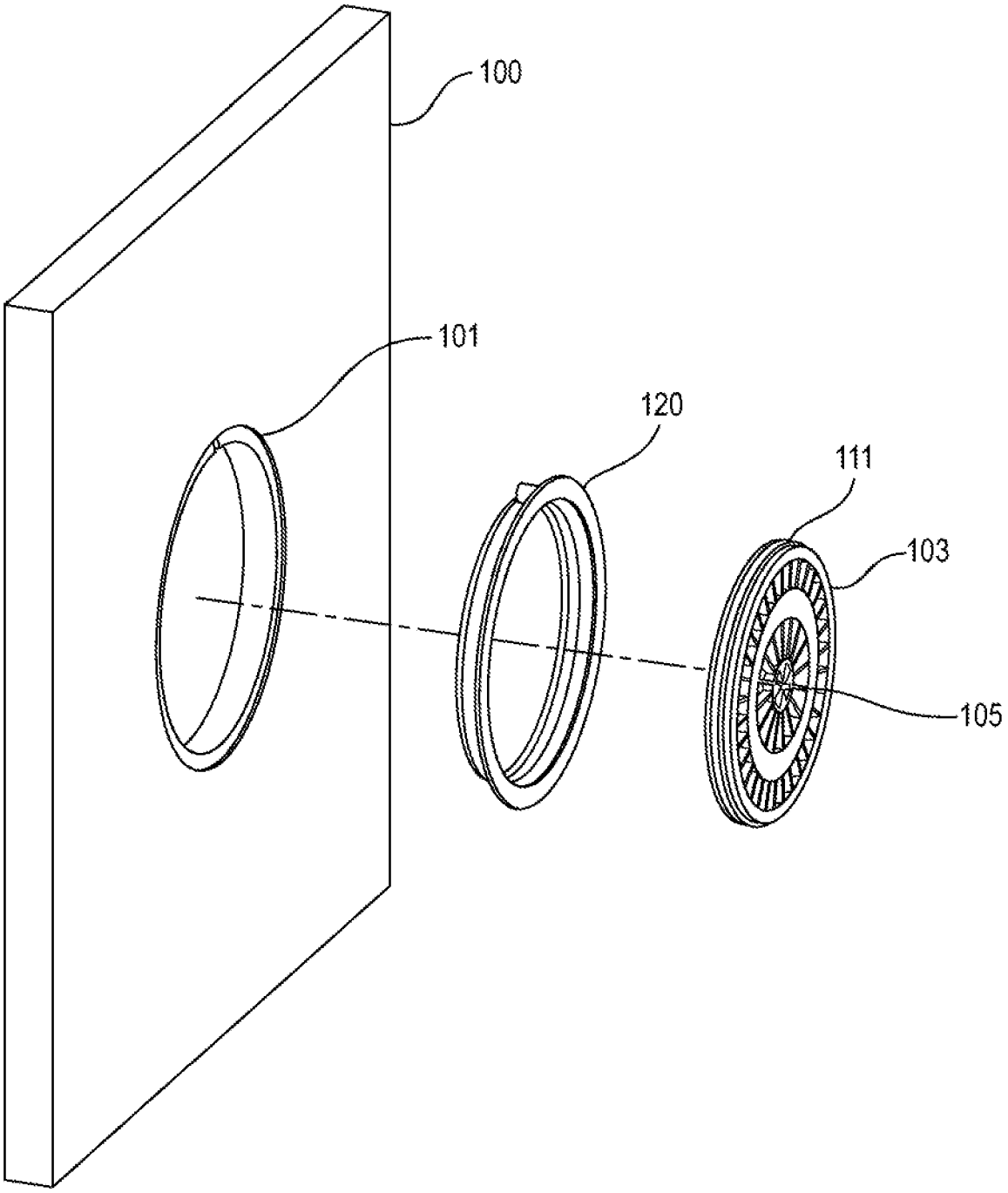
FIG. 13 is an exploded perspective view showing an image with a circular carve-out on the back center of an image, a circular ring to be adhered into the carve-out on the image, and a circular mounting plate, according to an embodiment of the present invention.

FIG. 5 shows a carve-out 101 on the back of the image 100 at or near the center of the image on the x-axis and near or above the center on the y-axis. In an embodiment, the carve-out 101 is designed and sized to fit directly onto a mounting plate 103 without an engineered receptacle. In other embodiments, a pre-formed plastic cup is fixedly placed into the carve-out 101 to form the receptacle 102. FIGS. 6 and 7 show images of plastic cups used for the receptacle 102. FIGS. 9 and 10 show images of the receptacle 102 placed in the carve-out 101. In another embodiment, as shown in FIG. 13, a pre-formed plastic ring 120 is fixedly placed into and along the inner edge of the carve-out 101 to form the receptacle 102. An advantage to using a cup or ring in the carve-out 101 to form a receptacle 102 is that it may help to reinforce the carve-out 101 and may provide for a more precise fit between the receptacle 102 and the mounting plate 103 because the cup or ring may be engineered and manufactured to receive the mounting plate 103 with a frictional means. In other embodiments, the carve-out 101 is elongated on the y-axis to receive an elongated receptacle 102 cup or ring as shown in FIG. 8.

FIG. 10 shows the preferred location of the carve-out 101 on the back of the image 100. The x-axis represents left and right as the image 100 is being placed over the mounting plate 103 that has been adhered to the mounting surface. The y-axis represents up and down on the mounting surface as the image 100 is being placed over the mounting plate 103. In a preferred embodiment of this invention, the carve-out 101 is located on the back of the image 100 near the center of the image 100 both on the x-axis and the y-axis. In other embodiments, the carve-out 101 may be located at or near the center of the image 100 on the x-axis and at or above the center of the image 100 on the y-axis.

Figure 11:
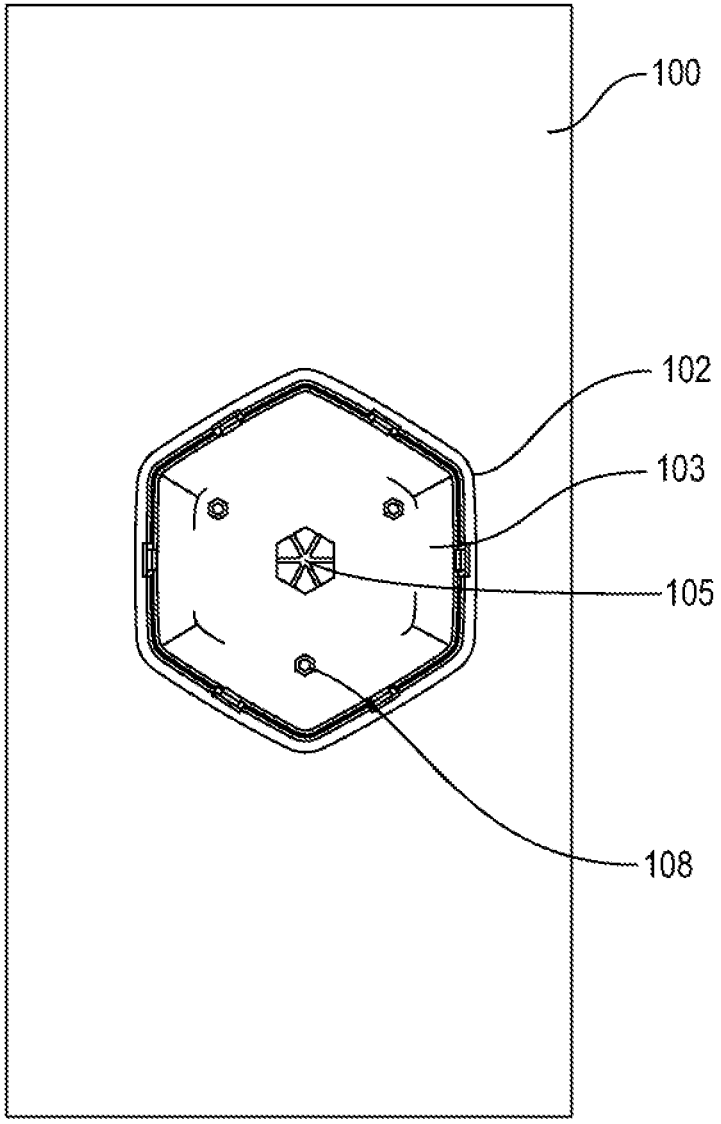
FIG. 11 is back view of an image with a hexagonal carve-out on the back center of the image located at or near the center of the x-axis and the y-axis, a hexagonal receptacle cup adhered into the carve-out on the image, and a hexagonal mounting plate inserted into the receptacle formed by the receptacle cup, according to an embodiment of the present invention.

FIG. 11 shows a view of a mounted image 100 from the back, including the receptacle 102 with the mounting plate 103 inserted into the receptacle 102 as well as the bulls-eye like opening 105 at the center of the mounting plate 103 and a plurality of standoffs 108.

Figure 12:
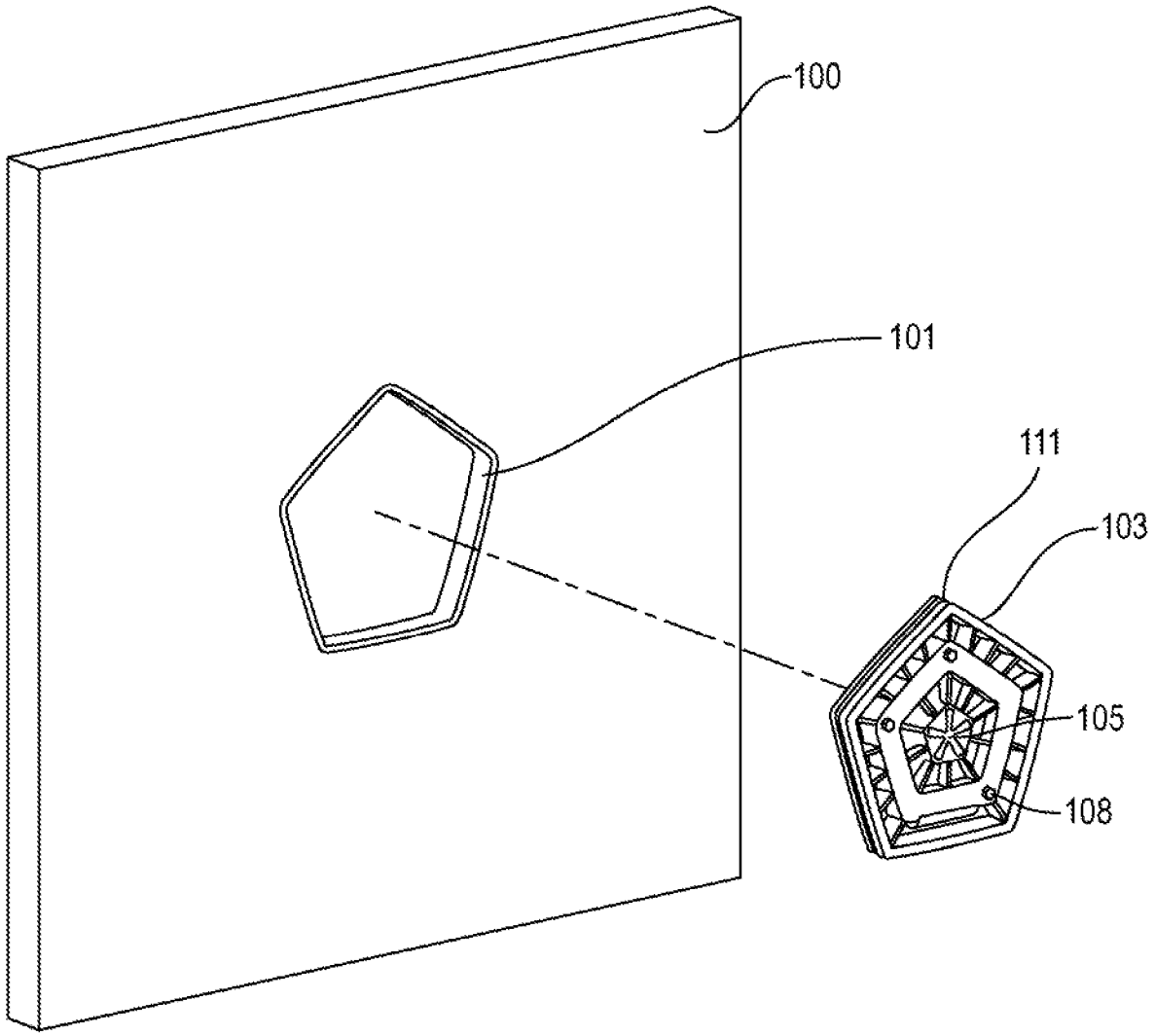
FIG. 12 an exploded perspective view showing an image with a pentagonal carve-out on the back center of an image, a pentagonal receptacle cup adhered into the carve-out on the image, and a pentagonal mounting plate, according to an embodiment of the present invention.

FIGS. 12 and 13 show alternative shapes being used for the carve-out 101 at the back of the image 100, the receptacle 102, and the mounting plate 103. FIG. 11 shows a pentagonal shape, and FIG. 12 shows a circular shape. The embodiment shown in FIG. 12 includes a ring 120 fixedly placed into the carve-out 101 to form the receptacle 102. In an embodiment with a circular shaped mounting plate 103, a separate leveling means may not be necessary because the image 100 can be rotated around the circular mounting plate 103 after being mounted on a wall or other mounting surface.

Figure 14:
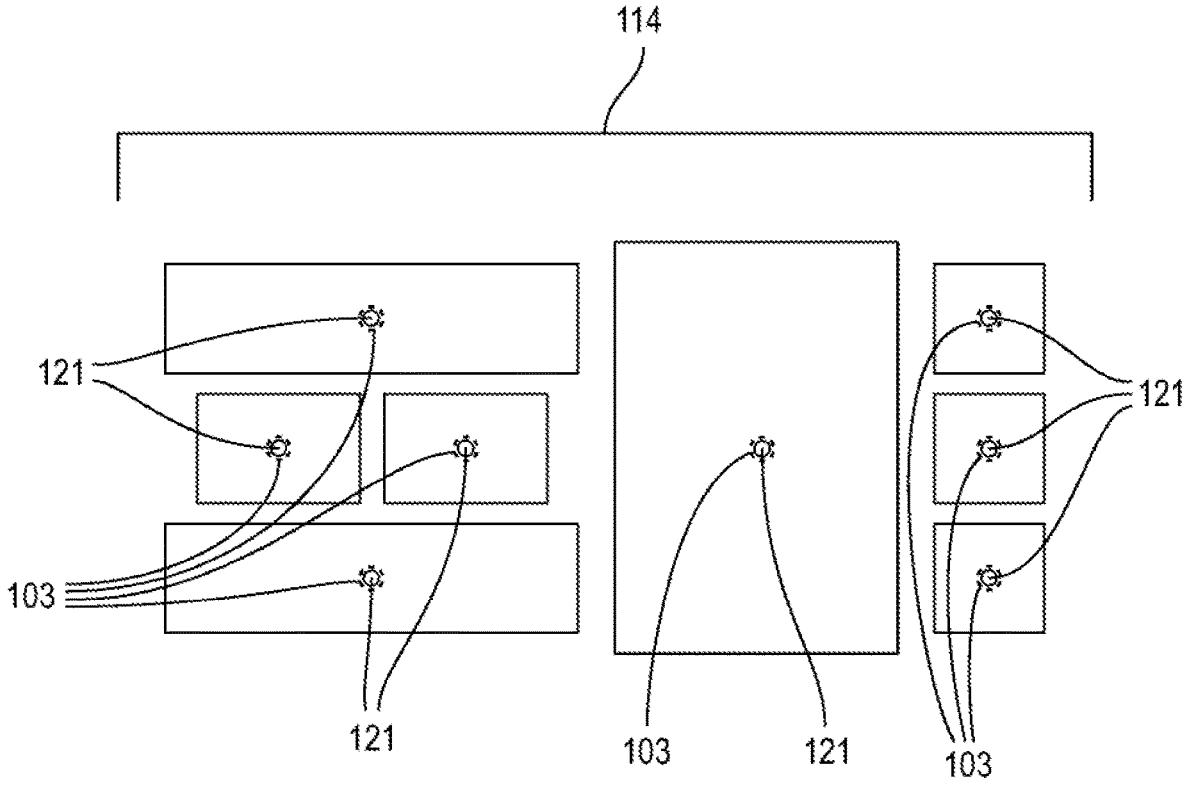
FIGS. 14 and 15 are illustrations of collage templates for use in locating the center a plurality of images on a wall or other mounting surface.
Figure 15:
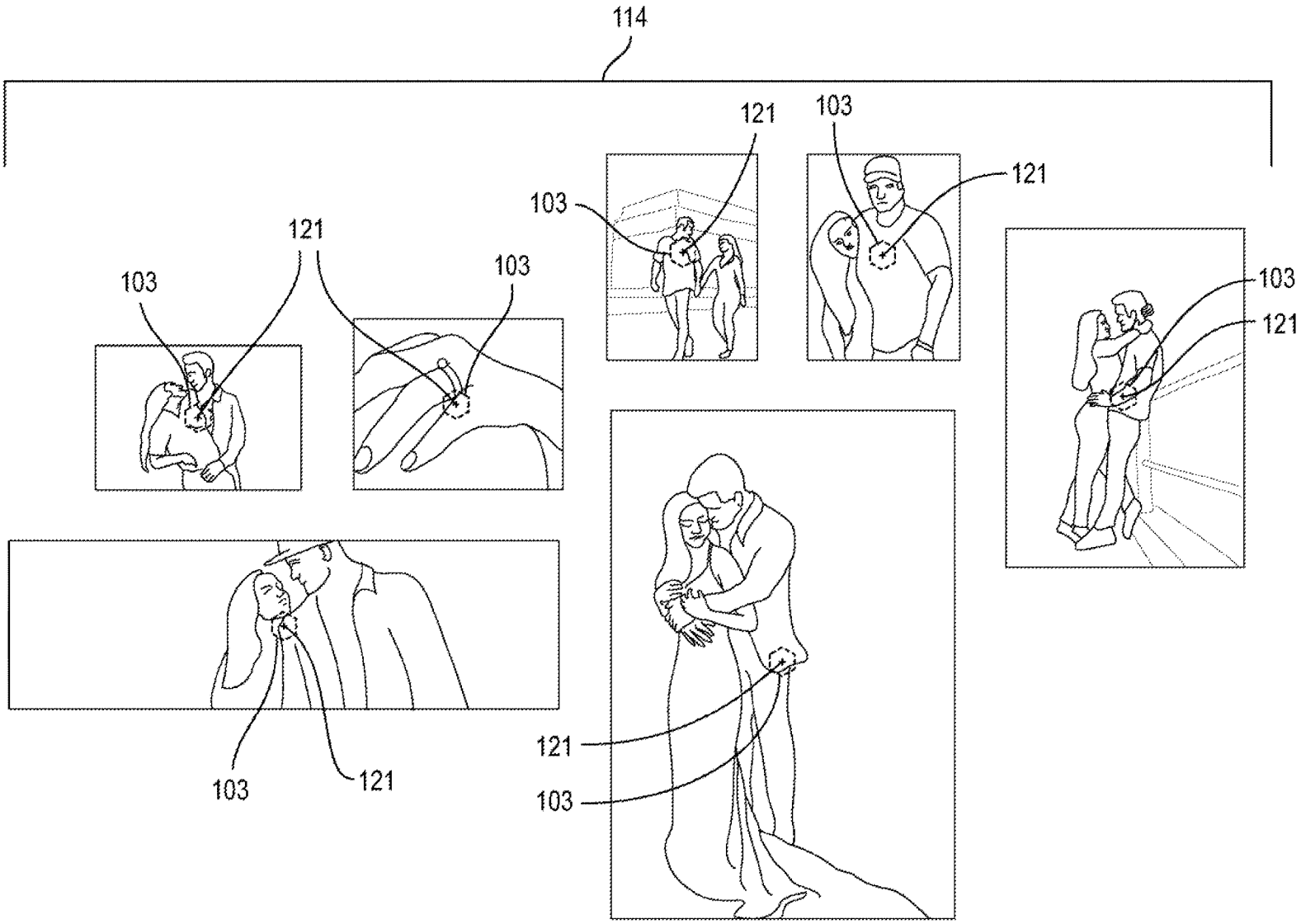

FIGS. 14 and 15 are illustrations of multi-image templates 114 used with the mounting device of the present invention to locate the center point for each mage 100 within collection of images. In an embodiment of this invention, a template 114 is selected from a library of predetermined templates for arranging the collection of images 100 on a mounting surface to form a collage or other arrangement of images. Each template 114 shows the shape and location of the receptacle 103 on the back of each image 100 within the template 114 and also shows the center point 121 of each mounting plate 103 for each image 100. Once the collage arrangement is selected, images 100 are sized based on the template 114 and then the template 114 may be attached or projected onto the mounting surface and used to identify and mark the center point for each mounting plate 103 to be placed onto the mounting surface.

The present invention advantageously allows for mounting one or more images 100 and laying out such images 100 using templates 114 that identify the center of each mounting plate 103 for each mage 100 that is to be mounted on the mounting surface for form a collage or collection of images 114. These predetermined locations for the mounting plates 103 within a collection of images 100 can be identified using the template 114 and do not require any additional measurements for locating the center of the mounting plates 103 or the images 100 on the mounting surface. The present invention also advantageously allows the images 100 to be mounted level on the mounting surface when the mounting plates 103 are leveled before each mounting plate 103 is removably affixed to the mounting surface and when the receptacle 102 on the back of the images 100 is placed over the level mounting plates 103. Templates 114 may be used for a single image or a plurality of images.

It is to be understood that the foregoing description is intended to illustrate and not limit the scope of the invention, which is defined by the scope of the appended claims. Other aspects, advantages, and modifications are within the scope of the following claims.

What is claimed is:

1. A method for leveling and mounting a solid core image on a mounting surface comprising the following steps:

Carving a receptacle into the backside of said solid core image, wherein said receptacle is located at or near the center of the image on the x-axis and at or above the center of the image on the y-axis, wherein the shape and size of the receptacle are designed for removably placing the receptacle onto a mounting plate, wherein the shape and size of said mounting plate are designed to fit within the receptacle, wherein said mounting plate has a bull's-eye opening at the center for aligning the mounting plate over a predetermined point on the mounting surface, wherein the mounting plate contains a means for leveling the mounting plate on the mounting surface before the mounting plate is removably attached to the mounting surface, wherein said mounting plate has a plurality of standoffs on the backside surface of the mounting plate to allow the mounting plate to be leveled on the mounting surface before the mounting plate is removably attached to the mounting surface, Placing the bull's eye opening of the mounting plate over a predetermined point on the mounting surface, Leveling the mounting plate on the mounting surface, Removably attaching said level mounting plate onto the mounting surface, Placing the receptacle over and pressing the receptacle onto the level mounting plate;

wherein the size, shape, and orientation of said receptacle are designed so that the image is level when mounted onto the level mounting plate, wherein one of the receptacle or the mounting plate has a means for providing friction between the inner edge of the receptacle and the outer edge of the mounting plate;

wherein the mounted image is flush to the mounting surface.

2. The method of claim 1 wherein the medium for the solid core image is foamcore.

3. The method of claim 1 wherein the medium for the solid core image is one of wood, metal, or plastic.

4. The method of claim 1 wherein the bull's-eye opening has a plurality of targeting guides to assist in placing the bull's eye opening over the predetermined mark on the mounting surface.

5. The method of claim 1 wherein the means for leveling the mounting plate is a bubble vial fixedly attached to the mounting plate.

6. The method of claim 1 wherein the means for leveling the mounting plate is a bubble vial removably attached to the mounting plate.

7. The method of claim 1 wherein the means for providing friction between the inner edge of the receptacle and the outer edge of the mounting plate is a rubber edging on the outer edge of the mounting plate.

8. The method of claim 1 wherein the shape of the receptacle and the mounting plate is one of hexagonal, pentagonal, octagonal, triangular, rectangular, square, star, any other polygonal shape, circular, oval, clover leaf, heart.

9. The method of claim 1 wherein the mounting plate is removably attached to the mounting surface with an adhesive strip.

10. The method of claim 1 wherein the mounting plate is removably attached to the mounting surface using a mechanical fastener.

11. The method of claim 1 wherein the mounting plate is removably attached to the mounting surface using an adhesive strip and one or more mechanical fasteners.

12. A method for leveling and mounting a solid core image on a mounting surface comprising the following steps:

Making a carve-out on the backside of said solid core image for placement of a receptacle, wherein said carve-out is located at or near the center of the image on the x-axis and at or above the center of the image on the y-axis, wherein the receptacle is fixedly adhered in the carve-out, wherein the shape and size of the receptacle are designed for removably placing the receptacle over and onto a mounting plate, wherein the shape and size of said mounting plate are designed to fit within the receptacle, wherein said mounting plate has a bull's-eye opening at the center for aligning the mounting plate over a predetermined point on the mounting surface, wherein the mounting plate contains a means for leveling the mounting plate on the mounting surface before the mounting plate is removably attached to the mounting surface, wherein said mounting plate has a plurality of standoffs on the backside surface of the mounting plate to allow the mounting plate to be leveled on the mounting surface before the mounting plate is removably attached to the mounting surface, Placing the bull's eye opening of the mounting plate over a predetermined point on the mounting surface, Leveling the mounting plate on the mounting surface, Removably attaching said level mounting plate onto the mounting surface, Placing the receptacle over and pressing the receptacle onto the level mounting plate, wherein the size, shape, and orientation of said receptacle are designed so that the image is level when mounted onto the level mounting plate, wherein one of the receptacle or the mounting plate has a means for providing friction between the inner edge of the receptacle and the outer edge of the mounting plate, wherein the image is flush to the mounting surface.

13. The method of claim 12 wherein the medium for the solid core image is foamcore.

14. The method of claim 12 wherein the medium for the solid core image is one of wood, metal, or plastic.

15. The method of claim 12 wherein the receptacle is a cup.

16. The method of claim 12 wherein the receptacle is a ring.

17. The method of claim 12 wherein the bull's eye opening has a plurality of targeting guides to assist in placing the bull's eye opening over the predetermined mark on the mounting surface.

18. The method of claim 12 wherein the means for leveling the mounting plate is a bubble vial fixedly attached to the mounting plate.

19. The method of claim 12 wherein the means for leveling the mounting plate is a bubble vial removably attached to the mounting plate.

20. The method of claim 12 wherein the means for providing friction is a mechanical connection between the outer edge of the mounting plate and the inner edge of the receptacle.

21. The method of claim 12 wherein the means for providing friction comprises elongating the receptacle on the y axis to allow the receptacle to be placed onto the mounting plate, slid downward, and removably locked into place on the mounting plate.

22. The method of claim 12 wherein the shape of the receptacle and the mounting plate is one of hexagonal, pentagonal, octagonal, triangular, rectangular, square, star, any other polygonal shape, circular, oval, clover leaf, heart.

23. The method of claim 12 wherein the mounting plate is removably attached to the mounting surface with an adhesive strip.

24. The method of claim 12 wherein the mounting plate is removably attached to the mounting surface using a mechanical fastener.

25. A method for leveling and mounting one or more solid core images on a mounting surface comprising the following steps:

Carving a receptacle into the backside of each aid solid core image, wherein each said receptacle is located at or near the center of each said image on the x-axis and at or above the center of the image on the y-axis, wherein the shape and size of each said receptacle are designed for removably placing the receptacle onto a mounting plate, wherein the shape and size of each said mounting plate are designed to fit within the receptacle, wherein each said mounting plate has a bull's-eye opening at the center for aligning the mounting plate over a predetermined point on the mounting surface, wherein the predetermined point for each said mounting plate is identified using a template placed onto the mounting surface, wherein said template identifies the location of each said image in relationship to all other said images, identifies the location of the receptacle for each said image, and identifies the center point for each said receptacle, wherein each said mounting plate contains a means for leveling the mounting plate on the mounting surface before the mounting plate is removably attached to the mounting surface, wherein each said mounting plate has a plurality of standoffs on the backside surface of the mounting plate to allow the mounting plate to be leveled on the mounting surface before the mounting plate is removably attached to the mounting surface, Placing the bull's eye opening of each said mounting plate over each of the said predetermined points on the mounting surface, Leveling each said mounting plate on the mounting surface, Removably attaching each said level mounting plate onto the mounting surface, Placing the receptacle for each said mounting plate over and pressing the receptacle onto each said level mounting plate;

wherein the size, shape, and orientation of each said receptacle are designed so that the image is level when mounted onto the level mounting plate, wherein one of each said receptacle or each said mounting plate has a means for providing friction between the inner edge of the receptacle and the outer edge of the mounting plate, wherein each said mounted image is flush to the mounting surface.

26. A method for leveling and mounting one or more solid core images on a mounting surface comprising the following steps:

Making a carve-out on the backside of each said solid core image for placement of a receptacle, wherein each said receptacle is located at or near the center of each said image on the x-axis and at or above the center of the image on the y-axis, wherein each said receptacle is fixedly adhered in the carve-out for each said image, wherein the shape and size of each said receptacle are designed for removably placing the receptacle onto a mounting plate, wherein the shape and size of each said mounting plate are designed to fit within the receptacle, wherein each said mounting plate has a bull's-eye opening at the center for aligning the mounting plate over a predetermined point on the mounting surface, wherein the predetermined point for each said mounting plate is identified using a template placed onto the mounting surface;

wherein said template identifies the location of each said image in relationship to all other said images, identifies the location of the receptacle for each said image, and identifies the center point for each said receptacle, wherein each said mounting plate contains a means for leveling the mounting plate on the mounting surface before the mounting plate is removably attached to the mounting surface, wherein each said mounting plate has a plurality of standoffs on the backside surface of the mounting plate to allow the mounting plate to be leveled on the mounting surface before the mounting plate is removably attached to the mounting surface, Placing the bull's eye opening of each said mounting plate over each of the said predetermined points on the mounting surface, Leveling each said mounting plate on the mounting surface, Removably attaching each said level mounting plate onto the mounting surface, Placing the receptacle for each said mounting plate over and pressing the receptacle onto each said level mounting plate, wherein the size, shape, and orientation of each said receptacle are designed so that the image is level when mounted onto the level mounting plate, wherein one of each said receptacle or each said mounting plate has a means for providing friction between the inner edge of the receptacle and the outer edge of the mounting plate, wherein each said mounted image is flush to the mounting surface.

* * * * *